US005700009A

United States Patent [19]

Meoni

[11] Patent Number: 5,700,009

[45] Date of Patent: Dec. 23, 1997

[54] CASINO RANDOM NUMBER CARD COVERING GAME

[75] Inventor: Frank Meoni, Henderson, Nev.

[73] Assignee: Fast Action, Inc., Las Vegas, Nev.

[21] Appl. No.: 692,705

[22] Filed: Aug. 6, 1996

[51] Int. Cl.[6] ..... A63F 3/06

[52] U.S. Cl. ..... 273/269; 273/274; 273/309

[58] Field of Search ..... 273/269, 270, 273/271, 264, 148 R, 309, 274

[56] References Cited

U.S. PATENT DOCUMENTS

| | | | |
|---|---|---|---|
| 1,038,062 | 9/1912 | Albert | 273/269 |
| 1,655,380 | 1/1928 | Parker | 273/269 |
| 2,657,059 | 10/1953 | Selig | 273/269 X |
| 4,019,744 | 4/1977 | Pizur, Sr. | 273/269 |
| 4,172,597 | 10/1979 | Smith et al. | 273/269 X |
| 4,252,322 | 2/1981 | Onter | 273/269 |

FOREIGN PATENT DOCUMENTS

| | | | |
|---|---|---|---|
| 434847 | 2/1912 | France | 273/269 |
| 1295398 | 12/1962 | France | 273/269 |
| 1388675 | 12/1965 | France | 273/269 |
| 283753 | 1/1928 | United Kingdom | 273/269 |

*Primary Examiner*—William E. Stoll
*Attorney, Agent, or Firm*—Wagner, Murabito & Hao

[57] ABSTRACT

A game for entertaining and transferring casino chips between players. The inventive game includes a plurality of player stations situated around a random number generating device. A plurality of cards having numbers thereon are provided for selection by each player. Casino chips are placed onto the cards in accordance with the random number generated by the random number generating device. The player placing casino chips onto all numbers of the card is declared the winner and collects unplaced casino chips from the remaining players.

9 Claims, 4 Drawing Sheets

CASINO RANDOM NUMBER CARD COVERING GAME

BACKGROUND OF THE INVENTION

1. Field of the Invention

The present invention relates to gaming devices and more particularly pertains to a casino random number card covering game for entertaining and transferring casino chips between players.

2. Description of the Prior Art

The use of gaming devices is known in the prior art. More specifically, gaming devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art gaming devices include U.S. Pat. No. 4,981,301; U.S. Pat. No. 4,875,686; U.S. Pat. No. 4,863,173; U.S. Pat. No. 4,798,387; and U.S. Pat. No. 4,732,392.

While these devices fulfill their respective, particular objectives and requirements, the aforementioned patents do not disclose a casino random number card covering game for entertaining and transferring casino chips between players which includes a plurality of player stations situated around a random number generating device, and a plurality of cards having numbers thereon for selection by each player, wherein casino chips are placed onto the cards in accordance with the random number generated, with the player placing casino chips onto all numbers of the card being declared the winner and collecting unplaced casino chips from the remaining players.

In these respects, the casino random number card covering game according to the present invention substantially departs from the conventional concepts and designs of the prior art, and in so doing provides an apparatus primarily developed for the purpose of entertaining and transferring casino chips between players.

SUMMARY OF THE INVENTION

In view of the foregoing disadvantages inherent in the known types of gaming devices now present in the prior art, the present invention provides a new casino random number card covering game construction wherein the same can be utilized for entertaining and transferring casino chips between players. As such, the general purpose of the present invention, which will be described subsequently in greater detail, is to provide a new casino random number card covering game apparatus and method which has many of the advantages of the gaming devices mentioned heretofore and many novel features that result in a casino random number card covering game which is not anticipated, rendered obvious, suggested, or even implied by any of the prior art gaming devices, either alone or in any combination thereof.

To attain this, the present invention generally comprises a game for entertaining and transferring casino chips between players. The inventive game includes a plurality of player stations situated around a random number generating device. A plurality of cards having numbers thereon are provided for selection by each player. Casino chips are placed onto the cards in accordance with the random number generated by the random number generating device. The player placing casino chips onto all numbers of the card is declared the winner and collects unplaced casino chips from the remaining players.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new casino random number card covering game apparatus and method which has many of the advantages of the gaming devices mentioned heretofore and many novel features that result in a casino random number card covering game which is not anticipated, rendered obvious, suggested, or even implied by any of the prior art gaming devices, either alone or in any combination thereof.

It is another object of the present invention to provide a new casino random number card covering game which may be easily and efficiently manufactured and marketed.

It is a further object of the present invention to provide a new casino random number card covering game which is of a durable and reliable construction.

An even further object of the present invention is to provide a new casino random number card covering game which is susceptible of a low cost of manufacture with regard to both materials and labor, and which accordingly is then susceptible of low prices of sale to the consuming public, thereby making such casino random number card covering games economically available to the buying public.

Still yet another object of the present invention is to provide a new casino random number card covering game which provides in the apparatuses and methods of the prior art some of the advantages thereof, while simultaneously overcoming some of the disadvantages normally associated therewith.

Still another object of the present invention is to provide a new casino random number card covering game for entertaining and transferring casino chips between players.

Yet another object of the present invention is to provide a new casino random number card covering game which includes a plurality of player stations situated around a random number generating device, and a plurality of cards having numbers thereon for selection by each player, wherein casino chips are placed onto the cards in accordance with the random number generated, with the player placing casino chips onto all numbers of the card being declared the winner and collecting unplaced casino chips from the remaining players.

Even still another object of the present invention is to provide a new casino random number card covering game wherein casino chips are placed onto the cards in accordance with the random number generated, with the player placing casino chips onto all numbers of the card being declared the winner and collecting unplaced casino chips from the remaining players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
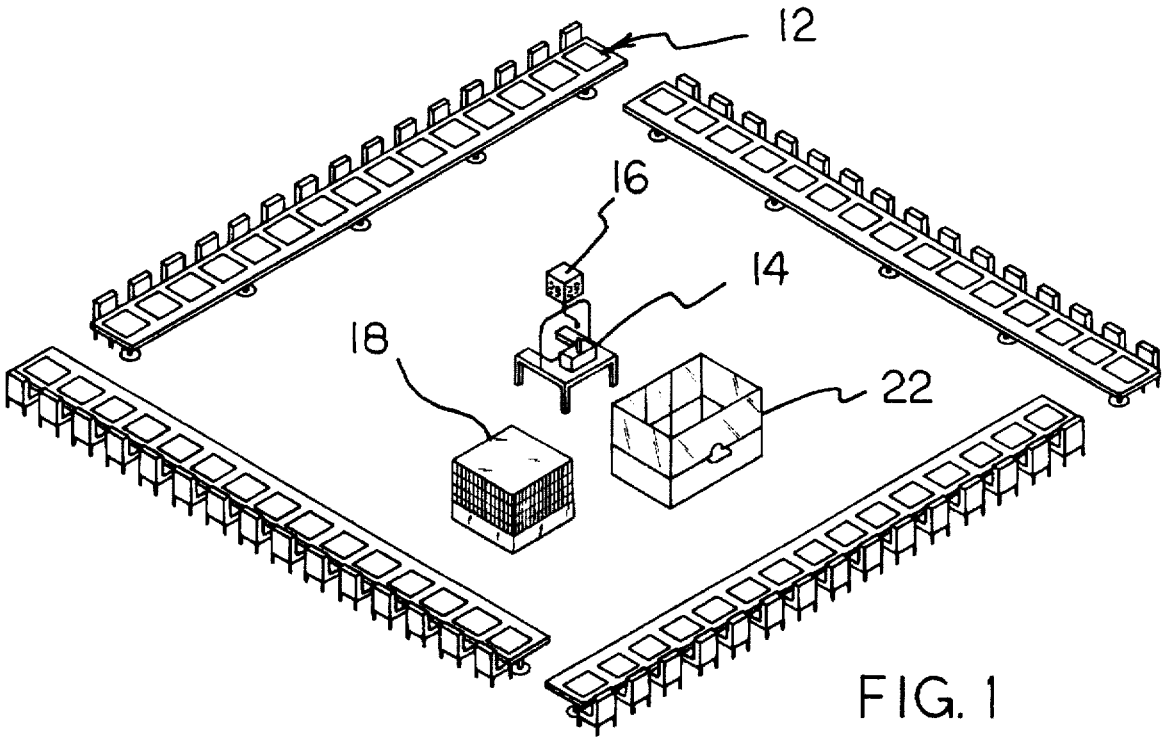
FIG. 1 is an isometric illustration of a casino random number card covering game according to the present invention.
Figure 2:
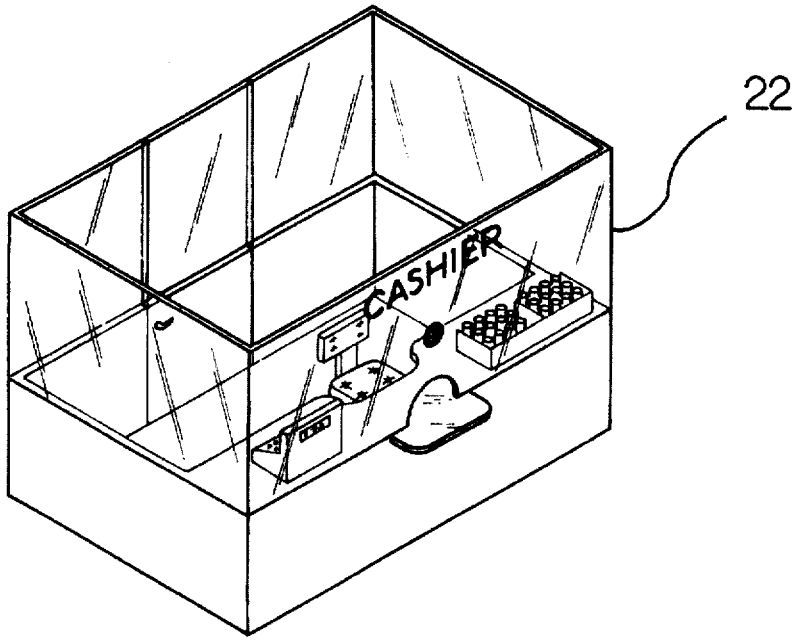
FIG. 2 is an isometric illustration of a cashier booth comprising a portion of the present invention.

With reference now to the drawings, and in particular to FIGS. 1–8 thereof, a new casino random number card covering game embodying the principles and concepts of the present invention and generally designated by the reference numeral 10 will be described.

Figure 3:
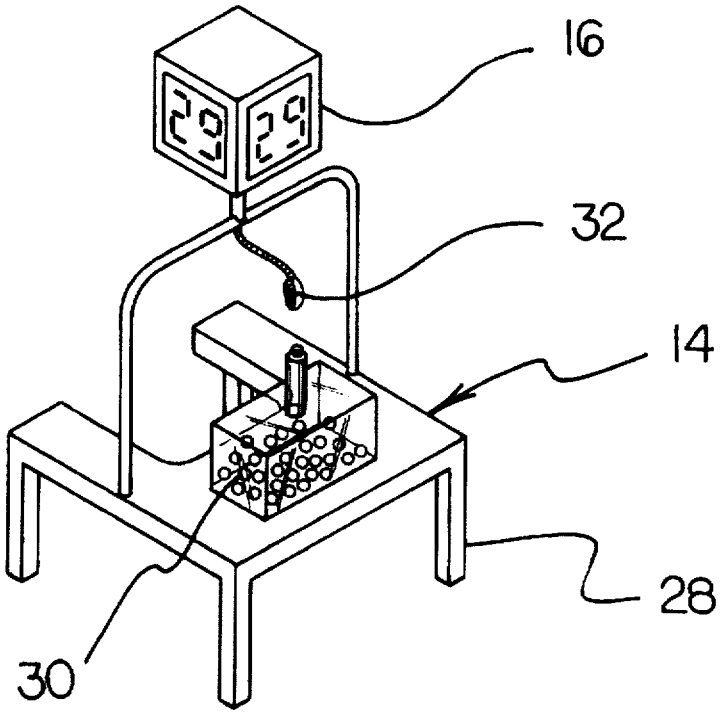
FIG. 3 is an isometric illustration of a random number generating means according to the invention.
Figure 4:
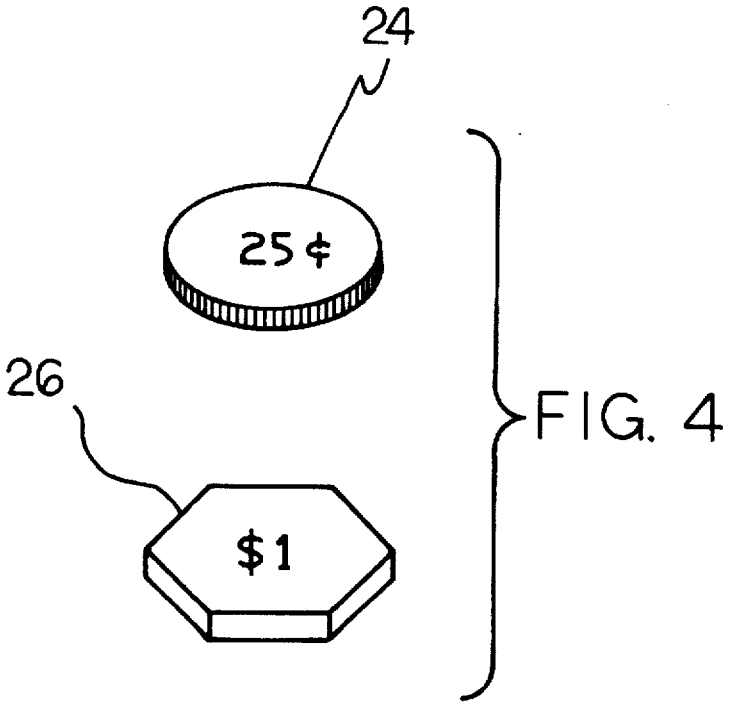
FIG. 4 is an isometric illustration of a plurality of disparate casino chips utilized in the invention.
Figure 5:
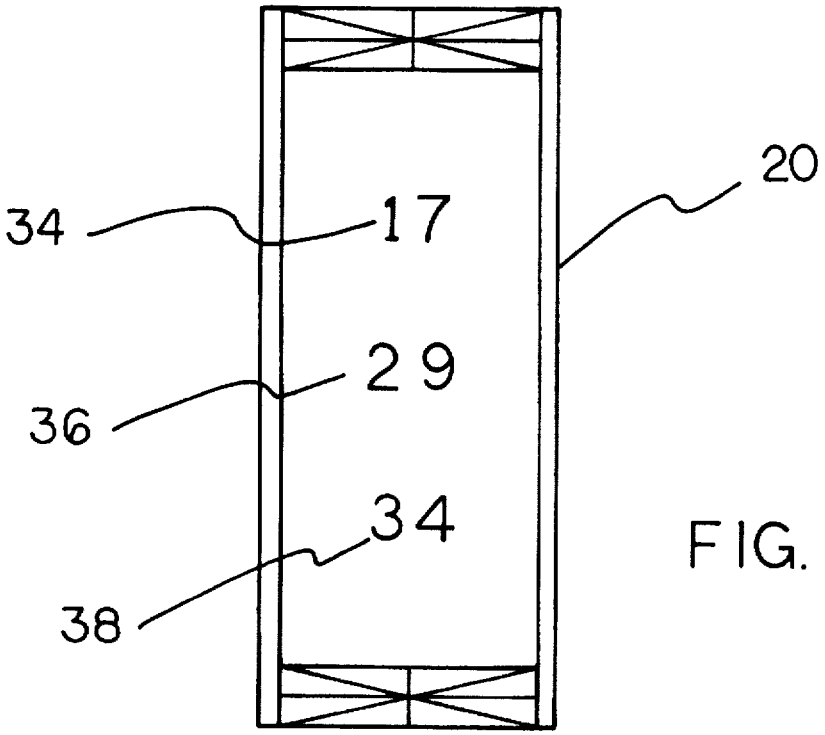
FIG. 5 is a plan view of a card of the invention.
Figure 6:
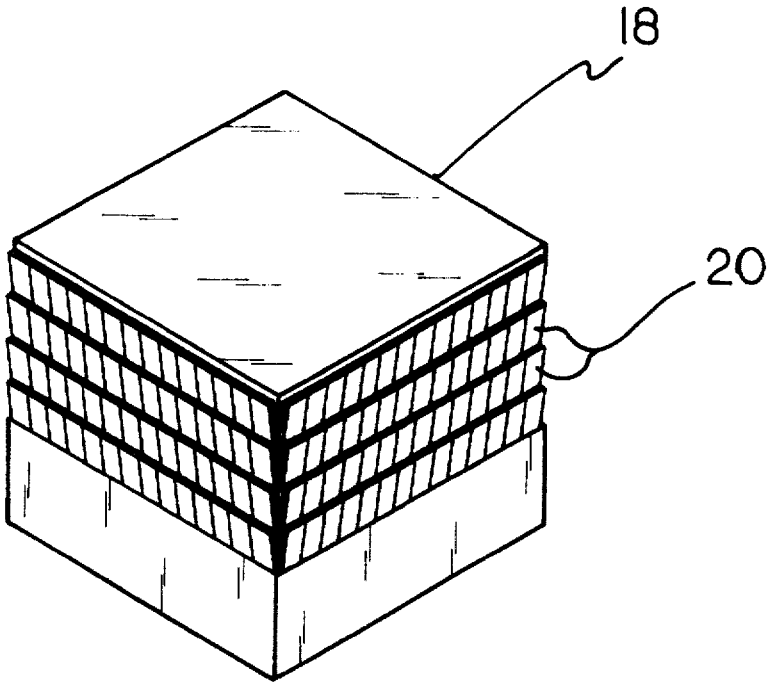
FIG. 6 is an isometric illustration of a rack for holding a plurality of the cards.

More specifically, it will be noted that the casino random number card covering game and method 10 comprises a plurality of player stations 12 which are preferably in the form of an elongated table having a plurality of unlabelled chairs situated proximal to each table. Preferably, the player stations 12 are situated such that a total of four tables are arranged in a square configuration with the chairs being positioned such that all players face towards a center of the square configuration. A random number generating means 14 is positioned within a center of the square configuration for generating a random number displayed for viewing by a display 16 operatively connected thereto. A card rack 18 is situated within the square configuration of the player stations 12 and holds a plurality of cards 20, as shown in FIGS. 5 and 6, for selection and subsequent use by players of the game method. A cashier booth 22 for exchanging legal tender money for casino tokens, such as the chips illustrated in FIG. 4, can also be situated within the square configuration of the player stations 12. Preferably, the chips or tokens include a circular chip 24 and a polygonal chip 26, as shown in FIG. 4. The random number generating means 14, is illustrated in FIG. 3 may simply comprise a table 28 having a random numbered ball selector 30 mounted thereon which randomly selects a single numbered ball from a plurality of agitated balls contained within a transparent container. The display 16 can be mounted above the table 28 for indicating the random number generated by the random number generating means 14. Further, a microphone 32 and an audio system can be provided such that an operator of the random number generating means 14 can announce the selective random number. As shown in FIG. 5, each of the cards 20 is substantially rectangular in shape and includes a plurality of numbers positioned thereon. Preferably, the numbers include an upper number 34 printed proximal to a first end of the card 20, a middle number 36 printed proximal to a center of the card, and a lower number 38 printed proximal to a second end of the card. The cards 20 can be stored within the rack 18 during periods of non-use, wherein players of the game method select cards from the rack prior to commencement of the game method. Preferably, the numbers 34–38 on the cards 20 range from one to thirty-six, with no two cards having the same combination of numbers printed thereon. Further, it is desirable that the numbers 34 and 38 are also disparate relative to one another. In other words, the upper number 34 is different than the middle number 36, which in turn is different than the lower number 38.

Figure 7:
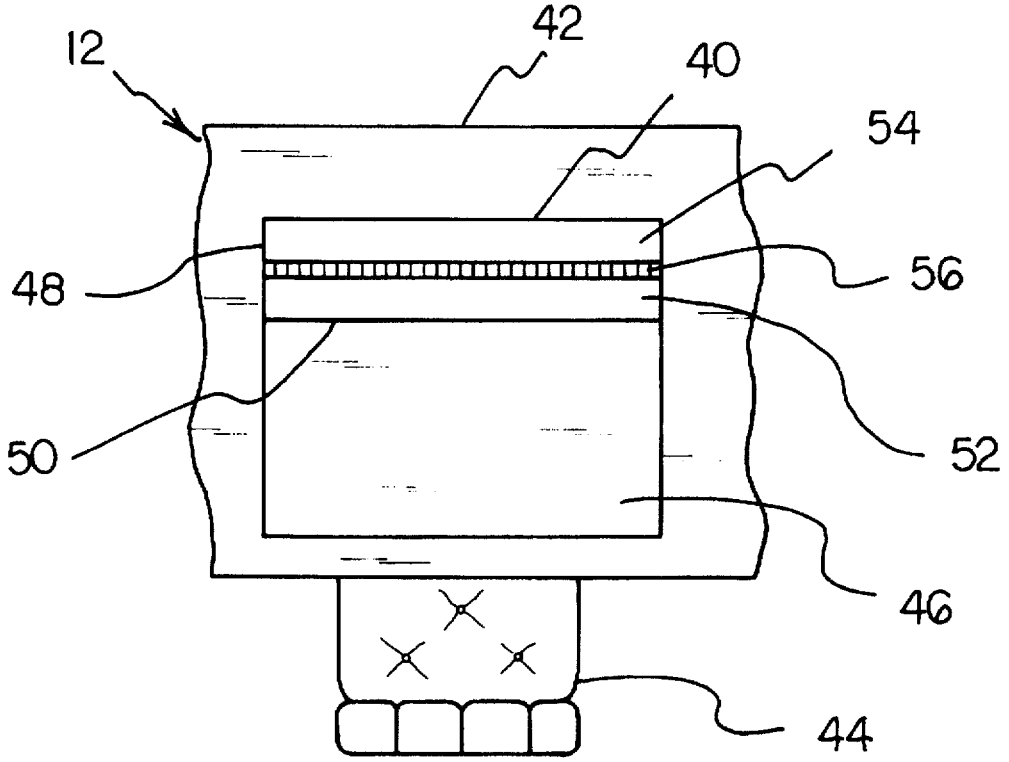
FIG. 7 is a top plan view of a player station of the invention.
Figure 8:
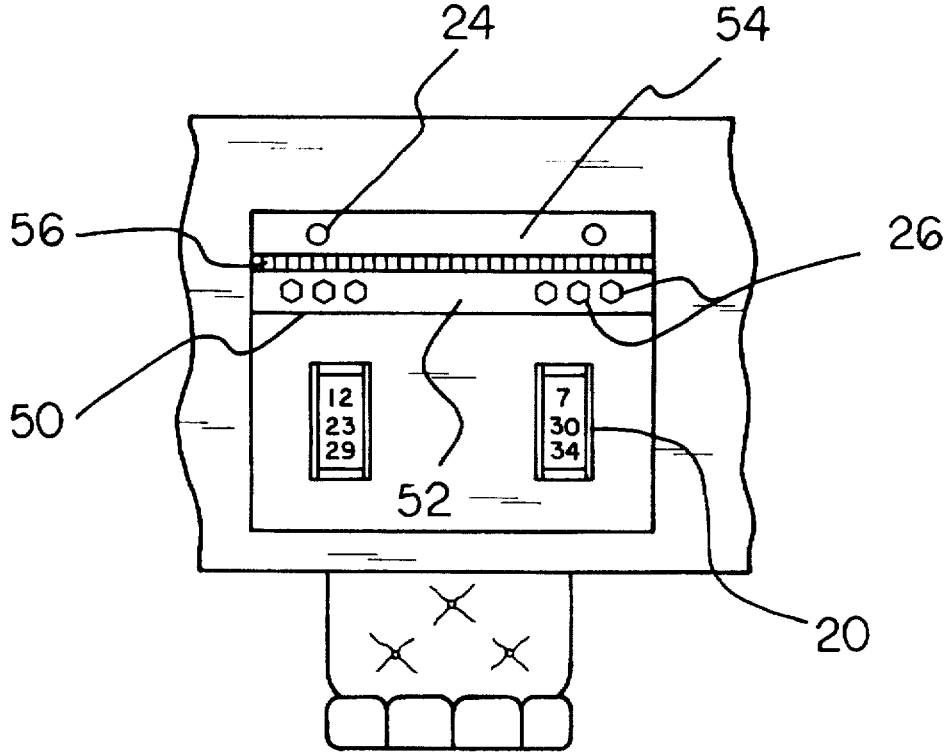
FIG. 8 is a top plan view of a player station prepared for commencement of the game method.

Referring now to FIGS. 7 and 8, it can be shown that each of the player stations 12 includes a playing surface 40 defined along a top portion of the table 42. The playing surface 40 is situated proximal to the chair 44 upon which a player resides during play of the game 10. The playing surface 40 can be recessed into the table 42, or alternatively simply printed thereon. The playing surface 40 includes a card area 46 of substantially rectangular configuration and a chip area 48 positioned forwardly of the card area. The chip area 48 is separated from the card area 46 by a black line 50 so as to demarcate the chip area 48 from the card area 46. Further, the chip area 48 is divided into a rear area 52 positioned adjacent to the card area 46, and a front area 54 by a red line 56 extending longitudinally through a medial portion of the chip area. By this structure, a player can position both cards 20 and chips 24, 26 in an organized fashion within the playing surface 40, such as is shown in FIG. 8.

To play the casino random number card covering game 10 according to the present invention, a player selects at least one card 20 from the card rack 18 and positions the card within the card area 46 of the playing surface 40. For each card 20 selected for play by an individual, a total of three polygonal chips 26 and one circular chip 24 must be purchased from the cashier booth 22. Preferably, the polygonal chips 26 convert to a value of one dollar each, with the circular chips 24 converting to a value of twenty-five cents. The three polygonal chips 26 are positioned within the rear area 52 of the chip area 48 behind the red line 56. The circular chip 24 is positioned into the front area 54 of the chip area 48 in front of the red line 56. Upon placement of the cards 20 and the chips 24 and 26 into the configuration illustrated in FIG. 8, commencement of the game method 10 may begin.

The game is started by a collection of the circular chips 24 by one or more individuals who referee the game method 10 and are referred to as "chip runners". The chip runners collect the circular chips 24 for disbursement to the house or casino in which the game 10 is being played. A random number is then created by the random number generating means 14 and announced and displayed to the players of the game. Should the random number generated correspond to one of the numbers 34–38 on the card 20, one of the polygonal chips 26 can be moved from in front of the black line 50 and onto the number corresponding to the random number generated. Another random number is generated as described above, with players continuing to position the polygonal chips 26 onto the corresponding numbers 34–38 of the cards 20. The winner of the game method 10 is defined as the player who first covers all the numbers 34–38 on a single card 20 in accordance with the game method 10 described above. The winner of the game 10 is then awarded the polygonal chips 26 from all the players at the player stations 12 which were not placed upon numbers 34–38 of the cards 20. In other words, the winner of the game 10 is awarded to only those polygonal chips 26 residing within the rear area 52 of the chip area 48. After a winner is declared and the polygonal chips 26 collected and awarded to the winner, play is again started by positioning the three polygonal chips 26 and a single circular chip 24 into the chip area 48 as described above.

In use, the casino random number card covering game 10 according to the present invention provides a novel method and means for entertaining and transferring casino chips between players.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A casino random number card covering game kit comprising:

a plurality of player stations including an elongated table having a plurality of chairs situated proximal to each table, wherein each of the player stations includes a playing surface extending along a top portion of the table, the playing surface including a card area and a chip area positioned forwardly of the card area, the chip area being separated from the card area by a first line so as to demarcate the chip area from the card area, the chip area being divided into a rear area positioned adjacent to the card area, and a front area positioned distal to the card area by a second line extending longitudinally through a portion of the chip area;

a random number generating means for generating a random number;

a plurality of cards, each of the cards including a plurality of numbers positioned thereon, the numbers including an upper number printed proximal to a first end of the card, a middle number printed proximal to a center of the card, and a lower number printed proximal to a second end of the card, the numbers being disparate relative to one another such that the upper number is different than the middle number, and the middle number is different than the lower number;

a plurality of tokens including a first token and a second token of disparate shape relative to the first token.

2. A method of playing a casino random number card covering game comprising the steps of:

providing the casino random number card covering game kit of claim 1;

selecting one of the cards;

placing a plurality of the first tokens within the rear area of the chip area behind the second line;

generating a random number;

determining if the random number matches one of the numbers of the card and moving one of the first tokens onto a matched number of the card;

declaring a winner of the game as a player who first covers all the numbers on the card.

3. The method of playing a casino random number card covering game of claim 2, and further comprising the step of:

awarding the winner the tokens from all other players at the player stations which were not placed upon numbers of a card.

4. A method of playing a casino random number card covering game comprising the steps of:

providing a casino random number card covering game kit comprising a plurality of player stations including an elongated table having a plurality of chairs situated proximal to each table; a random number generating means for generating a random number; a plurality of cards, each of the cards including a plurality of numbers positioned thereon; and a plurality of tokens, wherein each of the player stations includes a playing surface extending along a top portion of the table, the playing surface including a card area and a chip area positioned forwardly of the card area, the chip area being separated from the card area by a first line so as to demarcate the chip area from the card area, the chip area being divided into a rear area positioned adjacent to the card area, and a front area positioned distal to the card area by a second line extending longitudinally through a portion of the chip area;

selecting one of the cards;

placing a plurality of the first tokens within the rear area of the chip area behind the second line;

generating a random number;

determining if the random number matches one of the numbers of the card and moving one of the first tokens onto a matched number of the card;

declaring a winner of the game as a player who first covers all the numbers on the card.

5. The method of playing a casino random number card covering game of claim 4, and further comprising the step of:

awarding the winner the tokens from all other players at the player stations which were not placed upon numbers of a card.

6. A method of playing a casino random symbol card game, the method comprising the steps of:

a) providing a plurality of player stations including an elongated table having a plurality of chairs situated proximal to each table, each of the player stations including a playing surface extending along a top portion of the table, the playing surface including a card area and a chip area, the chip area having a first area and a second area;

b) generating a random symbol using a random symbol generator;

c) providing a plurality of cards, each of the cards including a plurality of symbols positioned thereon, the symbols including an upper symbol printed proximal to a first end of the card, a middle symbol printed proximal to a center of the card, and a lower symbol printed proximal to a second end of the card, the symbols being disparate relative to one another such that the upper symbol is different than the middle symbol, and the middle symbol is different than the lower symbol;

d) providing a plurality of tokens for placement into the second chip area;

e) if the random symbol matches one of the symbols of at least one of the cards, instructing the removal of a token from the second chip area for placement on the matching symbol of the matching card;

f) declaring a winner when a plurality of symbols are matched on at least one of the cards; and g) awarding the winner with any tokens from the second chip area not previously placed onto the cards.

7. A casino card covering game kit comprising:

a plurality of player stations each including a playing surface for extending along a top portion of a table, the playing surface including a card area and a separate chip area, the chip area being divided into a first area and a second area;

a random symbol generator for generating a random symbol;

a plurality of cards, each of the cards including a plurality of symbols positioned thereon, the symbols including an upper symbol printed proximal to a first end of the card, a middle symbol printed proximal to a center of the card, and a lower symbol printed proximal to a second end of the card, the symbols being disparate relative to one another such that the upper symbol is different than the middle symbol, and the middle symbol is different than the lower symbol; and a plurality of tokens including a first token type and a second token type of disparate shape relative to the first token type, wherein the tokens of the second token type are for placement within the second chip area when a game commences and the tokens of the second token type are for subsequent placement onto a card having a symbol that matches the random symbol.

8. The casino card covering game kit of claim 7 wherein each of the plurality of symbols included in each of the cards is a number and wherein the symbol generated by the random symbol generator is a number.

9. The casino card covering game kit of claim 7 wherein for each player station, the chip area is separated from the card area by a first line so as to demarcate the chip area from the card area, the first area of the chip area being a rear area and the second area of the chip area being a front area, the rear area being positioned adjacent to the card area and the front area positioned distal to the card area by a second line extending longitudinally through a portion of the chip area.

* * * * *